US005146905A

United States Patent [19]

Davis

[11] Patent Number: 5,146,905

[45] Date of Patent: Sep. 15, 1992

[54] CAPACITOR DISCHARGE IGNITION SYSTEM WITH DOUBLE OUTPUT COIL

[75] Inventor: James A. Davis, Ripon, Wis.

[73] Assignee: Brunswick Corporation, Skokie, Ill.

[21] Appl. No.: 723,851

[22] Filed: Jul. 1, 1991

[51] Int. Cl.[5] ..... F02P 3/06

[52] U.S. Cl. ..... 123/599; 123/634; 123/638

[58] Field of Search ..... 123/310, 596, 599, 621, 123/634, 638

[56] References Cited

U.S. PATENT DOCUMENTS

| | | | |
|---|---|---|---|
| 1,532,292 | 4/1925 | Woolson | 123/621 |
| 2,025,203 | 12/1935 | Harper, Jr. | 123/638 |
| 2,095,294 | 10/1937 | Sola | 336/165 |
| 2,643,274 | 6/1953 | Miller | 123/638 |
| 2,837,697 | 5/1958 | Berger | 315/138 |
| 2,878,455 | 3/1959 | Lamberton et al. | 336/183 |
| 3,273,099 | 9/1966 | Minks | 336/83 |
| 3,302,130 | 1/1967 | Minks | 331/112 |
| 3,448,423 | 6/1969 | Minks | 336/96 |
| 3,542,007 | 11/1970 | Minks | 123/599 |
| 3,549,944 | 12/1970 | Minks | 315/209 CD |
| 3,556,069 | 1/1971 | Minks | 123/143 C |
| 3,566,188 | 2/1971 | Minks | 315/209 T |
| 3,612,948 | 10/1971 | Minks | 315/209 SC |
| 3,675,077 | 7/1972 | Minks | 315/209 R |
| 4,177,782 | 12/1979 | Yoshinari et al. | 123/638 |
| 4,538,568 | 9/1985 | Fujikawa et al. | 123/638 X |
| 4,562,823 | 1/1986 | Moritugu et al. | 123/620 |
| 4,844,025 | 7/1989 | Sheaffer | 123/310 |
| 5,003,945 | 4/1991 | Hoeptner | 123/638 |

FOREIGN PATENT DOCUMENTS

| | | | |
|---|---|---|---|
| 1930378 | 9/1970 | Fed. Rep. of Germany | 123/638 |
| 2936 | of 1907 | United Kingdom | 123/638 |

*Primary Examiner*—Tony M. Argenbright
*Attorney, Agent, or Firm*—Andrus, Sceales, Starke & Sawall

[57] ABSTRACT

A capacitor discharge ignition system (10) for an internal combustion engine has an ignition coil (22) with a magnetically permeable core (24) having an axially extending core bar (26), a primary winding (30) wound around the core bar, and a pair of secondary windings (32 and 34) axially spaced along the primary winding. A pair of spark plugs (42 and 44) are each energized by a respective one of the secondary windings. The output voltage rise time of each of the secondary windings is fast enough and of sufficient magnitude to cause the respective spark plug to ignite a combustible mixture. The output voltage rise time of each of the secondary windings remains fast enough and of sufficient magnitude to cause its respective spark plug to ignite the combustible mixture even if the spark plug of the other secondary winding becomes fouled and presents a low impedance. Each of the secondary windings dissipates substantially constant energy even if the spark plug of the other secondary winding becomes fouled.

6 Claims, 2 Drawing Sheets

CAPACITOR DISCHARGE IGNITION SYSTEM WITH DOUBLE OUTPUT COIL

BACKGROUND AND SUMMARY

The invention relates to capacitor discharge ignition systems for internal combustion engines.

The invention arose during continuing development efforts relating to ignition systems for marine engines wherein ignition energy is stored in a capacitor and must be quickly discharged across a spark plug to provide enough spark to ignite the combustible mixture in the cylinder. The invention particularly arose during efforts to provide sufficient ignition energy for two spark plugs per cylinder, while still housing the ignition system, particularly the ignition coil or coils, within a reasonable size package as constrained by a marine application, particularly the limited space within the cowl of an outboard engine. The amount of output voltage available must be high enough to fire the spark plug, yet the coil must be packaged within a reasonable size.

DETAILED DESCRIPTION

Figure 1:
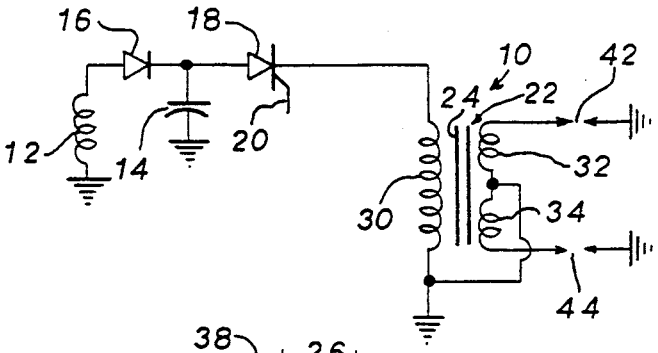
FIG. 1 is a circuit diagram showing a capacitor discharge ignition system in accordance with the invention.

FIG. 1 shows a capacitor discharge ignition system 10 for an internal combustion engine, including an alternator stator coil 12 energized by rotation of the engine to develop voltage, a capacitor 14 charged through diode 16 by voltage from stator coil 12, and a semiconductor switch 18 for discharging capacitor 14 in response to a trigger signal at 20, as is standard in the art, and for which further reference may be had to U.S. Pat. Nos. 3,273,099, 3,302,130, 3,448,423, 3,542,007, 3,549,944, 3,556,069, 3,566,188, 3,612,948, and 3,675,077, incorporated herein by reference. Diode 16 prevents discharge of capacitor 14 back through alternator stator coil 12 when the latter is not developing positive voltage.

Figure 4:
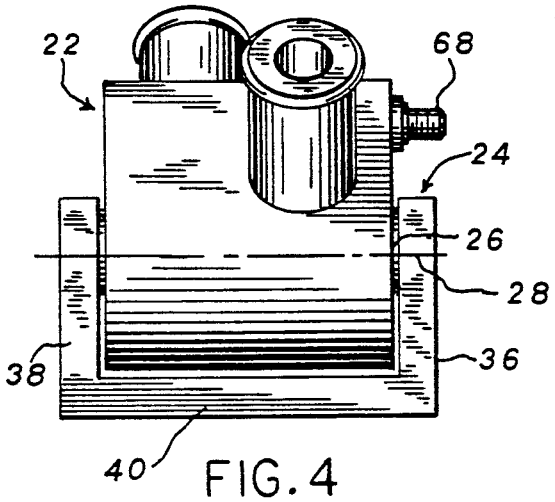
FIG. 4 is a side view of the coil of FIG. 2.
Figure 5:
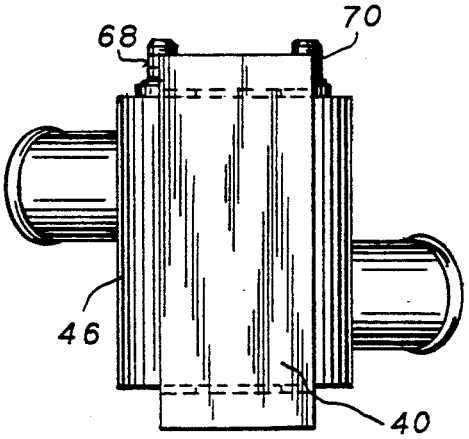
FIG. 5 is a bottom view of the coil of FIG. 2.
Figure 7:
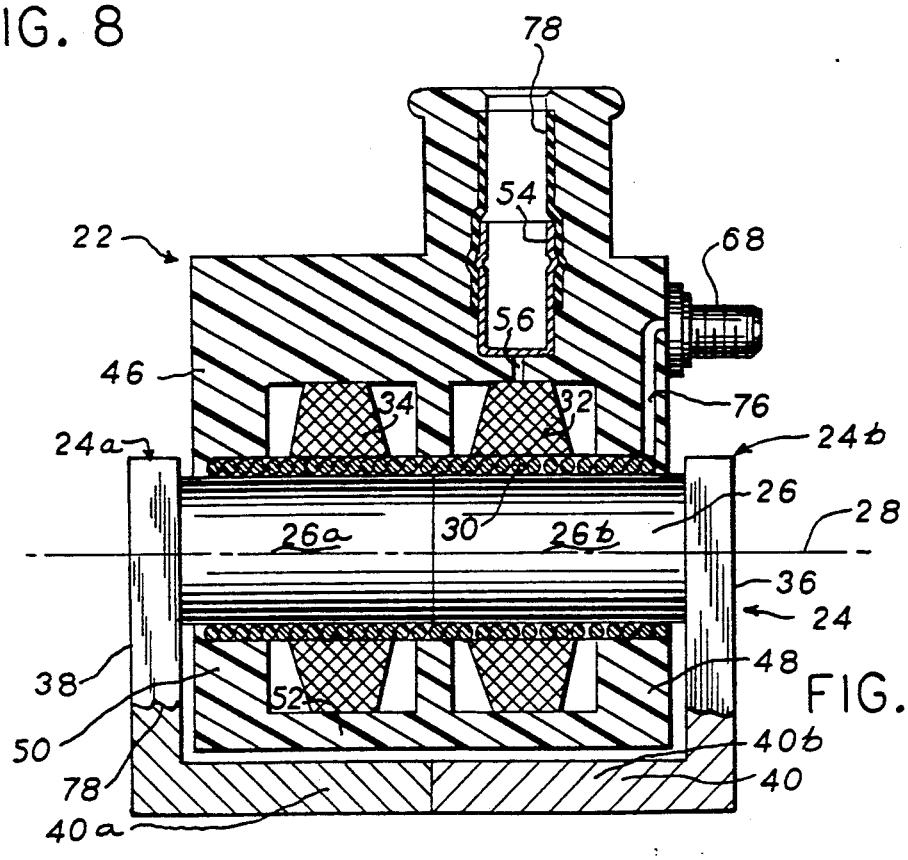
FIG. 7 is a sectional view taken along line 7—7 of FIG. 3.

Ignition coil 22 has a magnetically permeable ferrite core 24, FIGS. 1, 4 and 7, having an axially extending core bar 26 which extends along axis 28, a primary winding 30 wound around core bar 26 and energized by discharge of capacitor 14 through semiconductor switch 18, and a pair of secondary windings 32 and 34 axially spaced along primary winding 30, FIG. 7. Core 24 includes a magnetic flux return path outer yoke structure provided by a pair of arms 36 and 38, FIG. 4, at the axial ends of core bar 26 and extending radially therefrom and joined by yoke bar 40. Spark plug 42, FIG. 1, is energized by secondary winding 32, and spark plug 44 is energized by secondary winding 34. In one desirable implementation, the invention is used with an engine having a dual spark plug combustion chamber as shown in U.S. Pat. No. 4,844,025, incorporated herein by reference, wherein each cylinder has two spark plugs. It has been found that the output voltage rise time of each of secondary windings 32 and 34 is fast enough and has sufficient magnitude to cause the respective spark plug 42 and 44 to ignite the combustible mixture in the engine cylinder.

It has further been found that the output voltage rise time of each secondary winding remains fast enough and has sufficient magnitude to cause its respective spark plug to ignite the combustible mixture even if the spark plug of the other secondary winding becomes fouled and presents a low impedance. Furthermore, each of the secondary windings dissipates substantially constant energy even if the spark plug of the other secondary winding becomes fouled and presents a low impedance. Both of these results are surprising because they are contrary to expectations. It would be expected that if one of the secondary windings were to be connected to a low impedance, e.g. a fouled spark plug, while the other was connected to a high impedance, i.e. a normal spark plug, then the major portion of the primary winding energy would be dissipated in the fouled plug. However, test results do not confirm this expected performance, but instead show very little affect on the output of one secondary winding when the load on the other secondary winding is changed to a low impedance.

An outboard marine engine ignition was tested with a crankshaft mountable rotor spinning at 3,200 rpm and developing 195 volts at primary coil 30. The turns ratio was 17 turns for primary coil 30, 2,000 turns for secondary coil 32, and 2,000 turns for secondary coil 34. The resistances of secondary coils 32 and 34 were 967 ohms and 940 ohms, respectively. At a normal load, namely 100 megohms in parallel with 50 picofarads, for each of the secondary windings 32 and 34, i.e. simulating a spark plug and gap and high tension wiring, the output voltages were 26.9 kilovolts across secondary winding 32, and 28.0 kilovolts across secondary winding 34, with a rise time for each of 4 microseconds. The load on secondary winding 34 was then grounded to simulate a fouled spark plug, while the noted normal load remained on secondary winding 32. The resulting voltage across secondary winding 32 was 26.4 kilovolts with a rise time of 3 microseconds. Likewise, when the load on secondary winding 32 was grounded to simulate a fouled spark plug, while the noted normal load remained on secondary winding 34, the resulting voltage across secondary winding 34 was 27.6 kilovolts, also with a rise time of 3 microseconds. By way of comparison, standard prior art ignition coils presently in use typically have primary winding voltages of about 200 volts, secondary winding voltages of about 32 kilovolts, and secondary voltage rise times of about 4 microseconds.

Core bar 26, primary winding 30, and secondary windings 32 and 34 are coaxial and embedded in an electrically insulating housing 46 extending axially along axis 28 and having a pair of end walls 48 and 50 at opposite axial ends of the housing and having a circumferential sidewall 52 extending axially between end walls 48 and 50. A first electrically conductive female terminal cup 54 in sidewall 52 is radially aligned with secondary winding 32 for connection thereto at embedded wire 56. A second electrically conductive female terminal cup 58 in sidewall 52 is radially aligned with secondary winding 34 for connection thereto at embedded wire 60. Terminal cups 54 and 58 are spaced along axis 28 so that they are radially aligned with respective secondary coils 32 and 34 which are spaced along axis 28. Terminal cups 54 and 58 are also arcuately spaced about the circumference of housing 46. The noted spacings provide physical separation of the terminals to electrically isolate same and also to facilitate ease of connection of the respective high tension cable boot from the respective spark plug.

Figure 2:
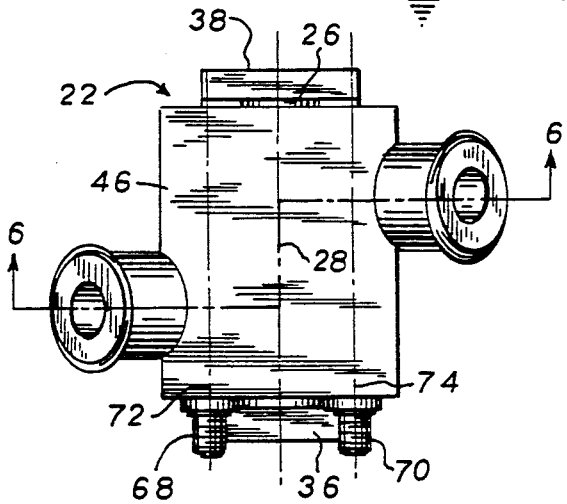
FIG. 2 is a top view of the construction of the coil assembly of FIG. 1.
Figure 3:
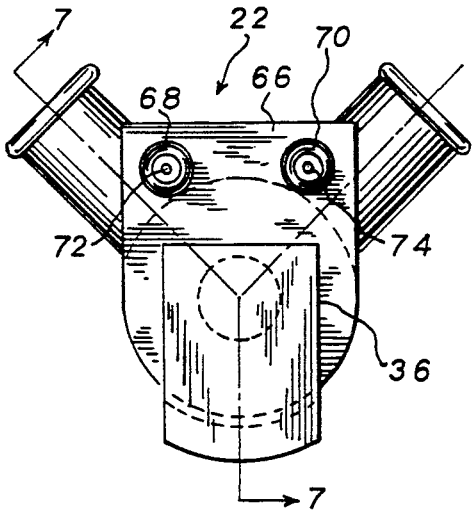
FIG. 3 is an end view of the coil of FIG. 2.

Terminal cups 54 and 58 extend along radial axes 62 and 64, respectively, each intersecting the axis 28. Radial axes 62 and 64 are axially spaced along axis 28. Radial axes 62 and 64 define a V-shape in end view, FIGS. 6 and 3. Housing 46 includes increased stock thickness portion 66, FIG. 6, between terminal cups 54 and 58 to form a frusto-V-shape and receiving male terminal posts 68 and 70 in end wall 48. Posts 68 and 70 extend axially and parallel to each other and perpendicular to each of terminal cups 54 and 58 extending along respective radial axes 62 and 64. Terminal posts 68 and 70 extend along axes 72 and 74, respectively, each within the V of the above noted V-shape, FIGS. 3 and 2. Terminal post 68 is connected to primary winding 30 by embedded wire 76, and terminal post 70 is connected to the opposite end of primary winding 30 by another embedded wire (not shown). Secondary windings 32 and 34 are connected to each other and to one of terminal posts 68 and 70 by another embedded wire (not shown) to provide ground connection.

Figure 6:
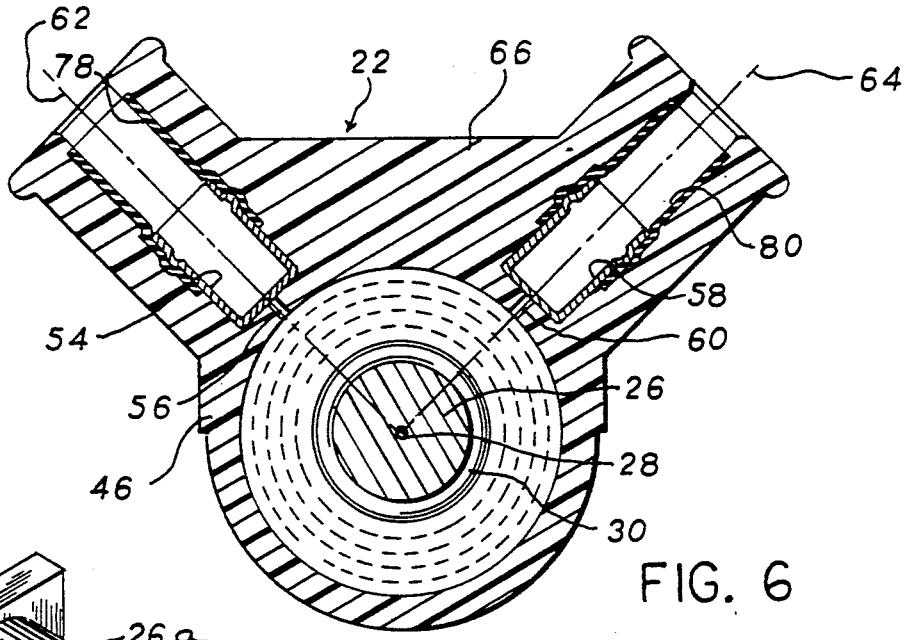
FIG. 6 is a sectional view taken along line 6—6 of FIG. 2.
Figure 8:
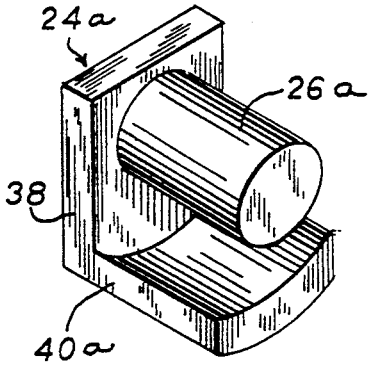
FIG. 8 is a perspective view of a portion of the structure of FIG. 7.

The ignition coil is produced by pouring epoxy into a mold under vacuum, as in the prior art for single output coils. Pins (not shown) are used to position terminal cups 54 and 58 and leave a hole through which the high tension spark plug lead can reach the respective terminal cup. Electrically insulating heat shrink tubing 78 and 80, FIG. 6, is used to seal the respective terminal cup to the respective pin and prevent the epoxy from filling the terminal cups during the molding operation. Core 24 is a two piece member, as in the prior art, one of which is shown at **24*a* in FIG. 8, which pieces are slid into the coil, one from each opposite axial end, after molding. Core piece 24*a* has a core bar 26*a*, an end arm 38, and a connecting yoke 40*a*. Core piece 24*b*, FIG. 7, has a core bar 26*b*, an end arm 36, and a connecting yoke 40*b*. The magnetic flux path is from core bar 26*a* to core bar 26*b* to arm 36 to connecting yoke 40*b* to connecting yoke 40*a* to arm 38 and back to core bar 26*a*. The assembled core is covered with an electrically insulating coating 78**.

It is recognized that various equivalents, alternatives and modifications are possible within the scope of the appended claims.

I claim:

1. A capacitor discharge ignition system for an internal combustion engine, comprising:

a stator coil energized by rotation of said engine to develop voltage;

a capacitor charged by voltage from said stator coil;

a semiconductor switch for discharging said capacitor;

an ignition coil comprising a magnetically permeable core having an axially extending core bar, a primary winding wound around said core bar and energized by discharge of said capacitor through said semiconductor switch, and a pair of secondary windings energized by said primary winding;

a pair of spark plugs each energized by a respective one of said secondary windings, the output voltage rise time of each of said secondary windings being fast enough and of sufficient magnitude to cause the respective spark plug to ignite a combustible mixture in said engine, wherein said core bar, said primary winding, and said secondary windings are coaxial and embedded in an electrically insulating housing extending axially and having a pair of end walls at opposite axial ends of said housing and having a circumferential sidewall extending axially between said end walls, said secondary windings are axially spaced from each other along the axis of said core bar, a first terminal in said sidewall and radially aligned with one of said secondary windings, a second terminal in said sidewall and radially aligned with the other of said secondary windings.

2. The ignition system according to claim 1 wherein said first and second terminals are axially spaced from each other along the axis of said core bar, and wherein said first and second terminals are arcuately spaced from each other about the circumference of said housing.

3. The ignition system according to claim 2 wherein said first and second terminals extend along radial axes each intersecting the axis of said core bar, said radial axes being axially spaced along said axis of said core bar.

4. The ignition system according to claim 3 wherein said radial axes of said first and second terminals define a V-shape in end view.

5. The ignition system according to claim 2 comprising third and fourth terminals at one of said end walls of said housing, said third and fourth terminals extending axially and parallel to each other and perpendicular to each of said first and second terminals.

6. The ignition system according to claim 5 wherein said first and second terminals extend along radial axes each intersecting the axis of said core bar, said radial axes being axially spaced along said axis of said core bar, said radial axes defining a V-shape in end view, said third and fourth terminals extending along axial axes each within the V of said V-shape.

* * * * *